United States Patent [19]

Koizumi et al.

[11] Patent Number: 4,802,999

[45] Date of Patent: Feb. 7, 1989

[54] LUBRICATING GREASE

[75] Inventors: Takehiro Koizumi; Hideo Matsuzawa, both of Tokyo, Japan

[73] Assignee: Shell Oil Company, Houston, Tex.

[21] Appl. No.: 163,245

[22] Filed: Mar. 2, 1988

Related U.S. Application Data

[63] Continuation-in-part of Ser. No. 934,103, Nov. 24, 1986, abandoned.

[30] Foreign Application Priority Data

Apr. 30, 1986 [JP] Japan ..... 61-98100

[51] Int. Cl.[4] ..... C10M 123/02

[52] U.S. Cl. ..... 252/18; 252/25

[58] Field of Search ..... 252/18, 25

[56] References Cited

U.S. PATENT DOCUMENTS

| | | | |
|---|---|---|---|
| 3,565,802 | 2/1971 | West et al. | 252/25 |
| 3,758,407 | 9/1973 | Harting | 252/18 |
| 3,836,467 | 9/1974 | Jones | 252/18 |
| 3,912,639 | 10/1974 | Adams | 252/25 |
| 3,988,248 | 10/1976 | Grasshoff | 252/18 |
| 4,376,060 | 3/1983 | Stadler | 252/25 |
| 4,401,580 | 8/1983 | Frost | 252/25 |
| 4,435,296 | 3/1984 | Brooks et al. | 252/25 |
| 4,435,299 | 3/1984 | Carley et al. | 252/18 |
| 4,737,299 | 4/1988 | Grasshoff et al. | 252/18 |

FOREIGN PATENT DOCUMENTS

| | | | |
|---|---|---|---|
| 212297 | 12/1982 | Japan | 252/25 |

*Primary Examiner*—William R. Dixon, Jr.
*Assistant Examiner*—Jerry D. Johnson
*Attorney, Agent, or Firm*—Cushman, Darby & Cushman

[57] ABSTRACT

Lubricating grease having high dropping point, superior stability against oxidation and long life is obtained by having a thickener contained in grease, said thickener comprising the three components:

a. lithium soap of $C_{12-24}$ hydroxyfatty acid,
b. lithium phosphate salt produced from phosphoric or phosphorous acid ester and
c. dilithium borate.

9 Claims, No Drawings

LUBRICATING GREASE

CROSS REFERENCE TO RELATED APPLICATIONS

This is a continuation-in-part of application Ser. No. 934,103 filed Nov. 24, 1986, now abandoned.

BRIEF SUMMARY OF THE INVENTION

The present invention relates to lubricating grease having higher dropping point, superior stability against oxidation and long life, which contains a thickener comprising the following three all together:

a. lithium soap of $C_{12-24}$ hydroxyfatty acid,
b. lithium phosphate salt produced from phosphoric or phosphorous acid ester and
c. dilithium borate.

BACKGROUND OF THE INVENTION

In recent years, machines and apparatuses are obliged to operate under higher temperature or under higher speed and heavier load. For instance, temperature of wheel bearing of automobiles often reaches 150°–200° C. due to friction heat with a disk-brake. Under the circumstances, grease has been desired which is resistant to higher temperature and has long life. As lithium soap-based grease is high temperature resistant, grease containing lithium soap of hydroxyfatty acid and monolithium borate has been proposed (Japanese published examined patent application Nos. 2205/1979 and 47235/1982 and U.S. Pat. No. 4,376,060).

U.S. Pat. Nos. 4,435,299, 3,988,248 and Japanese Kokai No. 212297/1982 disclose greases of lithium soap of hydroxyfatty acid mixed with one element selected from lithium dicarboxylate, lithium tetraborate and lithium phosphate.

U.S. Pat. Nos. 3,912,639, 3,565,802 and 4,401,580 disclose greases containing lithium borate with or without lithium phosphate or lithium phosphite, but not lithium soap of hydroxyfatty acid. U.S. Pat. No. 3,836,467 discloses grease containing lithium phosphate or lithium phosphite, but neither lithium soap of hydroxyfatty acid nor lithium borate.

All of greases referred to above contain only one or two components selected from a. lithium soap of $C_{12-24}$ hydroxyfatty acid,
b. lithium phosphate salt produced from phosphoric or phosphorous acid ester or a mixture thereof and
c. dilithium borate.

Some of the greases have dropping point of as high as 260° C. but are inferior in consistency (penetration) or a parameter of mechanical properties. None of them has dropping point of 260° C. or higher as well as desirable consistency.

It has been found that addition of lithium phosphate to grease containing 12-hydroxystearic acid and lithium borate brings change in dropping point, that the change rate in dropping point varies depending on lithium borate employed, i.e., monolithium borate, dilithium borate or trilithium borate and that increase in dropping point is very large when dilithium borate is employed.

DETAILED DESCRIPTION

The invention provides a lubricating grease having higher dropping point, and superior stability against oxidation and long life. It is indispensable to contain a thickener comprising the three components all together:

a. lithium soap of $C_{12-24}$ hydroxyfatty acid,
b. lithium phosphate salt produced from phosphoric or phosphorous acid ester and
c. dilithium borate.

The amounts of hydroxyfatty acid and phosphoric or phosphorous acid ester are 3–100 parts by weight and 0.05–15 parts by weight per part by weight of boric acid.

The present grease is lithium soap-based one having higher dropping point not deteriorating inherent heat resistance, long life and water resistance. Substantially the same consistency as of conventional grease in respect to dropping point and penetration is provided with a smaller amount of a thickener than that required for the other types of lithium complexbase greases.

$C_{12-24}$ hydroxyfatty acid for lithium salt thereof includes straight, saturated or unsaturated aliphatic monocarboxylic acid having hydroxyl group in the molecule, for example, 2-hydroxydodecanoic acid, 2-hydroxytetradecanoic acid, 2-hydroxyhexadecanoic acid, 11-hydroxyhexadecanoic acid, ambrettolic acid, ricinoleic acid, ricinostearolic acid, 9-hydroxystearic acid, 10-hydroxystearic acid and 12-hydroxystearic acid. Preferable are 12-hydroxystearic acid and ricinoleic acid. The lithium salt of hydroxyfatty acid may be used alone or in a mixture.

Lithium phosphate or phosphite is made by allowing phosphoric acid, phosphorous acid or their ester to react with lithium hydroxide but the ester form is preferable from a view of dispersion in base oil. Phosphoric acid ester used as the starting material is, for example, trimethyl phosphate, triethyl phosphate, triisopropyl phosphate, tributyl phosphate, trilauryl phosphate, tristearyl phosphate, triphenyl phosphate, tricresyl phosphate, tri-2-ethylhexyl phosphate, tridecyl phosphate, trinonylphenyl phosphate, diphenyl monodecyl phosphate, trithiotrilauryl phosphate, trichloroethyl phosphate and phosphite ester thereof or acidic esters thereof. Their respective phosphorous acid esters are used when phosphorous acid ester is used as the starting material. When such ester is used as one of the starting materials, there are produced trilithium phosphate, trilithium phosphite or acid salts thereof together with alkyl alcohol or aryl alcohol. The alcohols should be distilled off before the lithium-phosphate or -phosphite is mixed with base oil of grease, since they give somewhat unfavorable influence to stability of the product grease. Accordingly, the starting ester material is preferably ester of lower alcohol.

Base oil may be any mineral oil, synthetic hydrocarbon oil or synthetic ester oil. For instance, it includes such ester oil as dioctyl sebacate and such synthetic oil as pentaerythritol ester of aliphatic monocarboxylic acid, poly α-olefinic oligomer such as octene-1/decene-1 copolymer, polyglycol oil, silicone oil, polyphenylether oil, halogenated hydrocarbon oil, alkylbenzene oil. Synthetic oil may be used alone or mixed with mineral oil. Oil to be used has about 2–500 cSt, preferably about 20–200 cSt, at 40° C.

The present lubricating grease may contain 2–30, preferably 5–20 % by weight of thickener. The thickener contains 3–100, usually about 5–80 parts by weight of hydroxyfatty acid, and 0.05–15, usually about 0.1–10 parts by weight of phosphoric or phosphorous acid ester per part by weight of boric acid.

The present grease may further contain various additives such as anti-oxidants, anti-rusts, extreme pressure agents, tackiness agents, etc.

TABLE 1

| | | The present grease | Comparative greases | | | | | |
|---|---|---|---|---|---|---|---|---|
| | | Z | A | B | C | D | E | F |
| Components | | | | | | | | |
| 12-hydroxystearic acid (HCOFA) | | 120 g | 120 g | 120 g | 120 g | 120 g | 120 g | 120 g |
| $H_3BO_3$ | | 12 | 12 | 12 | 12 | 12 | 12 | — |
| triethyl phosphate (TEP) | | 7.35 | — | 7.35 | — | 7.35 | — | 7.35 |
| $LiOH.H_2O$ | to HCOFA | 16.72 | 16.72 | 16.72 | 16.72 | 16.72 | 16.72 | 16.72 |
| | to $H_3BO_3$ | 16.30 | 16.30 | 8.15 | 8.15 | 24.45 | 24.45 | — |
| | to TEP | 5.08 | — | 5.08 | — | 5.08 | — | 5.08 |
| | Total | 38.10 | 33.02 | 29.95 | 24.87 | 46.25 | 41.17 | 21.80 |
| refined oil | | 1322.55 | 1334.88 | 1330.70 | 1343.13 | 1314.40 | 1326.83 | 1235.93 |
| form of lithium borate formed | | di Li-borate | di Li-borate | mono Li-borate | mono Li-borate | tri Li-borate | tri Li-borate | — |
| whether or not lithium phosphate is present | | Li-phosphate | — | Li-phosphate | — | Li-phosphate | — | Li-phosphate |
| *Dropping Point °C. | | 261 | 221 | 260 | 248 | 218 | 218 | 231 |
| Increase in dropping point °C. | | 40 | | | 12 | | 0 | |
| *Penetration at 25° C. | | 273 | 281 | 286 | 337 | 256 | 273 | 289 |

*JIS K 2220

EXAMPLE 1

One half of purified mineral oil to be used (paraffin base, viscosity index=96, pour point =−12.5° C., kinetic viscosity =104.9 and 11.50 cSt at 40° C. and 100° C., respectively), 12-hydroxystearic acid and triethyl hosphate were mixed and heated up to 80° C. until the 12-hydroxystearic acid was dissolved. Then, aqueous solution of boric acid and of lithium hydroxide monohydrate was added. The amount of lithium hydroxide monohydrate was stoichiometrically equivalent to produce lithium 12-hydroxystearate, trilithium phosphate and dilithium borate. After dehydration the mixture was heated to 200°-220° C. with stirring. Remaining purified mineral oil was added and the whole mixture was cooled to 80° C. and homogenized. Grease obtained was called as "Grease Z".

EXAMPLES 2-8

Greases A to F having different lithium borates, or no lithium borate or lithium phosphate were prepared, in the similar manner to Example 1.

Formulations and properties of the present grease (Z) and greases (A to F) are given in Table 1. Greases A, C and E contain 12-hydroxystearic acid and various lithium borates different from each other, respectively. When lithium phosphate is further added to each of these greases, i.e., the corresponding greases Z, B and D, respectively, dropping point changes and the change varies depending on lithium borate contained, i.e., monolithium borate, dilithium borate or trilithium borate. Dropping point of grease Z (the present) is 40° C. higher than that of grease A where dilithium borate is present in the two greases. Dropping point of grease B is 12° C. higher than that of grease C where monolithium borate is present in the two greases but there is no difference in dropping points between greases D and E where trilithium borate is present. Grease F containing the same amounts of 12-hydroxyfatty acid and lithium phosphate as those in grease Z but no lithium borates shows lower dropping point and poorer consistency than those of the present grease (Z).

The performance test results of grease Z are given in Table 2.

TABLE 2

| Performance test | | |
|---|---|---|
| Item | Test method | grease Z |
| consistency 60 W | JISK2220 5.3 | 273 |
| dropping point °C. | JISK2220 5.4 | 261 |
| corrosiveness (copper plate) 100° C. × 24 h (wt %) | JISK2220 5.5B | 1a |
| amount of evaporation 99° C. × 22 h (wt %) | JISK2220 5.6B | 0.14 |
| degree of oil separation 100° C. × 24 h (wt %) | JISK2220 5.7 | 0.37 |
| degree of oxidation stability 99° C. × 100 h (kg f/cm$^2$) | JISK2220 5.8 | 0.30 |
| degree of miscibility 100000 times | JISK2220 5.11 | 316 |
| degree of leakage 104.5° C. × 6 h (g) | JISK2220 5.13 | 0.8 |
| cold torque | | |
| −20° C. start gf-cm | JISK2220 5.14 | 4,940 |
| −20° C. rotation gf-cm | | 680 |
| degree of waterproof 79° C. × 1 h (%) | JISK2220 5.12 | 1.1 |
| wetting 14 days | ASTMD 2246 | A class |
| bearing performance test 3500 rpm × 150° C. (h) | ASTMD 1741 | 680 |
| Heat test unwork penetration (consistency) | JISK2220 | |
| at 25° C. after 100° C. × 24 h | | 262(−11) |
| at 25° C. after 150° C. × 24 h | | 248(−25) |

Table 2 shows that the present grease 1 has high dropping point, 2 is superior in stability against oxidation, heat resistance and water resistance and 3 has long life. Degree of oxidation stability (0.3 Kgf/cm$^2$) of grease Z is smaller than that of commercially available product (0.3-0.7 Kgf/cm$^2$). Figure such as "262(−11)" in heat test means that 11 smaller than consistency value of 273. These figures such as "−11" are smaller than those of conventional lithium grease, i.e., about −40 or −75, respectively. Degree of water proof is high. Bearing performance test value (680 hr) shows longer life, since average value of lithium grease is about 100 hr (3500 rpm × 150° C.).

We claim:

1. A lubricating grease comprising a base oil containing about 2–30 wt. % of a thickener consisting essentially of the combination of:

a. lithium soap of $C_{12-24}$ hydroxyfatty acid, b. lithium phosphate salt produced from phosphoric or phosphorous acid ester or a mixture thereof, and c. dilithium borate, the amount of phosphoric or phosphorous acid ester being 0.05–15 parts by weight and the hydroxyfatty acid being 3–100 parts by weight per part by weight of boric acid, respectively.

2. Lubricating grease according to claim 1 wherein the thickener is 5–20 % by weight.

3. Lubricating grease according to claim 1 wherein hydroxyfatty acid is about 5–80 parts by weight and phosphoric or phosphorous acid ester is about 0.1–10 parts by weight.

4. Lubricating grease according to claim 1 wherein the phosphoric acid ester is trimethyl phosphate, triethyl phosphate, triisopropyl phosphate, tributyl phosphate, trilauryl phosphate, tristearyl phosphate, triphenyl phosphate, tricresyl phosphate, tri 2-ethylhexyl phosphate, tridecyl phosphate, trinonylphenyl phosphate, diphenyl monodecyl phosphate, trithiolauryl phosphate, trichloroethyl phosphate or acid esters thereof.

5. Lubricating grease according to claim 1 wherein the lithium phosphate salt contains lithium salt of phosphoric or phosphorous acid.

6. Lubricating grease according to claim 1 wherein the hydroxyfatty acid is straight, saturated or unsaturated aliphatic mono-carboxylic acid having hydroxyl group in the molecule.

7. Lubricating grease according to claim 1 wherein the hydroxyfatty acid is 2-hydroxydodecanoic acid, 2-hydroxytetradecanoic acid, 2-hydroxyhexadecanoic acid, 11-hydroxyhexadecanoic acid, ambrettolic acid, ricinoleic acid, ricinostearic acid, 9-hydroxystearic acid, 10-hydroxystearic acid or 12-hydroxystearic acid.

8. Lubricating grease according to claim 1 wherein the hydroxyfatty acid is 12-hydroxystearic acid or ricinoleic acid.

9. Lubricating grease according to claim 1 wherein the base oil is mineral oil, synthetic hydrocarbon oil or synthetic ester oil.

* * * * *